US005178334A

United States Patent [19]

Hebert et al.

[11] Patent Number: 5,178,334

[45] Date of Patent: Jan. 12, 1993

[54] PROCESS FOR GERMANIUM ORE UPGRADING

[75] Inventors: Patrick Hebert, Maintenon; Jean-Jacques Predali, Elancourt, both of France

[73] Assignee: Metaleurop S.A., Fontenay-Sous-Bois, France

[21] Appl. No.: 845,811

[22] Filed: Mar. 9, 1992

Related U.S. Application Data

[63] Continuation of Ser. No. 541,801, Jun. 21, 1990, abandoned.

[51] Int. Cl.[5] ..... B02C 23/18; B02C 23/08

[52] U.S. Cl. ..... 241/21; 241/24

[58] Field of Search ..... 209/214, 215, 225; 241/24, 79.1, 21, 29, 76, 77, 78; 210/783

[56] References Cited

U.S. PATENT DOCUMENTS 3,754,713 8/1973 Kienast et al. ..... 241/24
4,511,461 4/1985 Kruyer ..... 210/783 X

FOREIGN PATENT DOCUMENTS 69403 6/1976 Japan ..... 241/24
1475715 4/1989 U.S.S.R. ..... 241/24

OTHER PUBLICATIONS

Annual Report, Musto Exploration Ltd., 1983.
Mining Journal, Dec. 2, 1983, pp. 395-396.

*Primary Examiner*—Timothy V. Eley
*Attorney, Agent, or Firm*—Jacobson, Price, Holman & Stern

[57] ABSTRACT

A process to increase the content of germanium which is found in an iron hydroxide phase of an ore of the supergene type for later recovery by solvent extraction. The process comprises the steps of first crushing the ore, converting the ore to pulp, and then subjecting the pulp to a magnetic separation to give a magnetic fraction enriched in germanium. Also, the process can be used to increase the content of gallium which is found in a jarosite phase of an ore of the supergene type for later recovery by solvent extraction.

22 Claims, No Drawings

PROCESS FOR GERMANIUM ORE UPGRADING

This application is a continuation of application Ser. No. 541,801, filed Jun. 21, 990, now abandoned.

The present invention relates to a process for the enrichment of an ore containing germanium and in some cases gallium.

Germanium is generally found in ores containing large amounts of zinc sulfide.

However, germanium is also present, in small amounts of the order of 800 to 3000 ppm, in ores of the "supergene" type originating from geological structures of the "iron hat" type. Such ores contain:

a siliceous phase;

carbonates (essentially dolomite);

iron hydroxides and in particular a mixture of limonite and goethite; and jarosite and plombo-jarosite.

DISCUSSION OF THE PRIOR ART

Germanium is recovered from such ores by the known technique of solvent extraction. However, a solution of this kind is inappropriate for low-grade ores because it then involves dressing costs which are incompatible with the market price of germanium. Moreover, the presence of large amounts of carbonates in ores substantially increases the acid consumption required for extraction, while the siliceous phase has a marked tendency to trap the germanium and hence reduce the extraction yield.

The aim of the present invention is to propose a process for appreciably increasing the germanium content of the ore so as to make the recovery by solvent substantially more economic.

A further object of the invention is at the same time to reduce the carbonate and silica content of the ore so as on the one hand to reduce the acid consumption and on the other to reduce the trapping of the germanium and increase the yield of the solvent extraction.

It has been found that, in an ore of the type indicated above, the germanium is associated virtually exclusively with the iron hydroxide phase (essentially goethite). Furthermore, it has also been found that the gallium-bearing phases are essentially present in jarosite.

SUMMARY OF THE INVENTION

The present invention is essentially based on the above finding and, according to a first feature, proposes a process for the enrichment of an ore of the supergene type containing germanium in an iron hydroxide phase of said ore, said process comprising the steps consisting in:

crushing the ore, converting the ore to pulp, and subjecting the pulp to a magnetic separation to give a magnetic fraction enriched in germanium.

The process of the invention makes it possible to remove from the ore a non-magnetic fraction containing only a small amount of iron hydroxide and considerable amounts of the other phases. Thus a considerably increased proportion of iron hydroxides, and consequently an increased germanium content, is obtained in the magnetic fraction.

According to a second feature, the invention further relates to a process for the enrichment of an ore of the supergene type containing germanium in an iron hydroxide phase and gallium in a jarosite phase of said ore, said process comprising the steps consisting in:

crushing the ore, converting the ore to pulp, and subjecting the pulp to a magnetic separation to give a magnetic fraction enriched in germanium and gallium.

DESCRIPTION OF THE PREFERRED EMBODIMENT

The various steps of the process according to the invention will now be described in detail and the results of comparative enrichment tests performed according to the present invention will now be indicated.

The first step of the process consists in crushing the ore to an upper particle size limit (expressed as its diameter $d_{80}$) of between 50 and 500 μm. Such values are chosen so as on the one hand to release the different phases of the ore from one another as far as possible, and on the other hand to remain within a range of sufficiently large sizes for the magnetic separation, which is to take place downstream, to be able to be carried out under normal conditions, especially without grain agglutination phenomena.

Preferably, the ore is crushed by a wet method with a solids concentration of between 50 and 65%.

The second step consists in diluting the resulting crushed pulp with water to a solids concentration preferably of between 50 and 500 g/l and most preferably of 150 to 200 g/l.

The diluted pulp is then passed through a magnetic separator operating with a magnetic field preferably of between 0.5 and 1.5 Tesla.

The magnetic fraction recovered constitutes the enriched ore, which, as will be seen below, has a substantially increased germanium and gallium content compared with the starting ore. More precisely, the effect of the magnetic separation is to retain a substantial part of the iron hydroxides in the magnetic fraction (concentrate), while the other phases of the ore, in particular the silica and the non-ferrous carbonates, are rejected or recycled with the nonmagnetic fraction.

Optionally, the concentrate can be retreated in the same magnetic separator in order to free it of impurities which may have been entrained with the ferromagnetic particles during the first separation. Also, the non-magnetic fraction collected after the first separation can be subjected to a further magnetic separation, with a higher field intensity than the first, in order to extract ferromagnetic particles remaining in the non-magnetic fraction after the first pass for want of a sufficiently intense field.

Comparative ore enrichment tests performed according to the present invention will now be described.

Test no 1

A germanium ore originating from the Apex mine (Utah, United States of America), containing 925 g/t of germanium and 490 g/t of gallium, was dressed by the process described above, under the following concrete conditions:

crushing to a $d_{80}$ of 100 micrometers;

passage through a high-intensity magnetic separator, in this case a separator manufactured by the American company CARPCO under the reference WHIMS 3×4L, equipped with "Jones" plates; several tests were performed with different values of the magnetic field;

recovery and analysis of the magnetic fraction for each different field intensity.

The starting ore had a grain size of between 0 and 20 mm (with a $d_{80}$ equal to 14.5 mm) and a moisture content of 3.6%.

The results obtained are presented in Table I below:

TABLE I

| Separation intensity | % by weight | content (g/t) Ge | content (g/t) Ga | recovery (%) Ge | recovery (%) Ga |
|---|---|---|---|---|---|
| 1 Ampere | 16.45 | 1790 | 977 | 31 | 31.5 |
| 2 Amperes | 31.96 | 1590 | 813 | 56.3 | 52.8 |
| 4 Amperes | 39.79 | 1535 | 700 | 66.1 | 60.1 |

The first column of the Table indicates the proportion by weight of the ore which ends up in the magnetic fraction. The last two columns indicate the proportion of each of the two elements in the magnetic fraction compared with their amount in the starting ore.

It is observed that the germanium and gallium enrichment increases considerably with the magnetic field intensity.

More complete analyses were carried out for the separation under 4 Amperes, which gave the best results.

These analyses are summarized in Table II below:

TABLE II

| | % by weight | % Fe | % $SiO_2$ | % Ca | % $CO_3$ |
|---|---|---|---|---|---|
| Concentrate | 39.79 | 31.7 | 30.8 | 0.49 | 0.58 |
| Sterile material | 60.21 | 11.9 | 66.5 | 1.07 | 2.60 |
| Unsorted material | 100.00 | 19.78 | 53.3 | 0.87 | 1.80 |

The results obtained show that the magnetic separation affords:

1) a substantial increase in the germanium content, which, in the present Example, increases from 925 to 1535 g/t for a current of 4 Amperes, i.e. a 65.9% enrichment;

2) an enrichment of the iron in the concentrate, its content increasing from 20 to 32%;

3) a substantial decrease in the $SiO_2$ content, which drops from 53.3% to 30.8%, and in the $CO_3$ content, which drops from 1.8 to less than 0.6%.

It is important to note here that these two decreases will facilitate the conventional type of hydrometallurgical process (solvent extraction) used downstream for extracting the germanium. More precisely, the decrease in the amount of carbonate reduces the acid consumption, while that the decrease in the amount of silica makes it possible to reduce the attack and the precipitation of colloidal silica, which is capable of trapping the germanium and thus lowering the extraction yield, and of creating filtration problems.

It is estimated that a germanium enrichment of the order of 75% can be obtained by using intensities even higher than 4 Amperes.

Test no 2

In order to study the influence of the mean size of the particles subjected to magnetic separation on the degree of enrichment obtained, germanium enrichment tests were performed on an ore, three samples of which were subjected to three different crushing operations. Here again, the ore was crushed in a wet medium with a solids concentration of between 50 and 65%.

The three crushing operations were intended to produce particle size ranges (expressed as the diameter $d_{80}$) of 53 micrometers, 100 micrometers and 200 micrometers.

With the exception of the information given above, the process was carried out as described earlier; the feed current to the magnetic separator was 4 Amperes.

The results obtained are summarized in Table III below:

TABLE III

| $d_{80}$ after crushing | % by weight | magnetic concentrate Ge (g/t) | magnetic concentrate recovery of Ge (%) |
|---|---|---|---|
| 53 μm | 27.88 | 1690 | 49.6 |
| 100 μm | 39.79 | 1535 | 66.1 |
| 200 μm | 43.82 | 1435 | 71.8 |

It is clearly apparent that the best enrichment is achieved with a $d_{80}$ of 200 micrometers. Furthermore, an even more larger particle size must be expected to result in even greater enrichment.

Thus another conclusion drawn from the tests performed according to the present invention is the fact that the best results seem to be obtained by crushing the ore to a particle size ($d_{80} \geqq 200$ μm which is substantially greater than the release mesh (measured on the sample as being about 60 μm) of the ore.

Test no 3

In this test, the influence of the size of the treated particles on the efficacy of magnetic separation was studied.

More precisely, the sample of ore, of the same type as previously, was crushed to a $d_{80}$ of 200 micrometers and then separated by screening into two fractions, one with a particle size of between 0 and 40 micrometers and the other with a particle size greater than 40 micrometers.

The two fractions were treated separately as indicated above, with a feed current to the magnetic separated of 4 Amperes.

The results of this test are presented in Table IV below:

TABLE IV

| | weight (%) | Ge content (g/t) | recovery of Ge (%) |
|---|---|---|---|
| Magnetic concentrate on +40 μm | 37.40 (58.03) | 1319 | 54.4 (87.6) |
| Non-magnetic material on +40 μm | 27.05 (41.97) | 258 | 7.7 (12.4) |
| Magnetic concentrate on 0–40 μm | 8.13 (22.86) | 1541 | 13.8 (36.6) |
| Non-magnetic material on 0–40 μm | 27.43 (77.14) | 790 | 23.9 (63.4) |
| Feed +40 μm | 64.44 (100.00) | 874 | 62.2 (100.00) |
| Feed 0–40 μm | 35.56 (100.00) | 962 | 37.8 (100.00) |
| Starting material ($d_{80}$ = 200 μm) | 100 | 905 | 100 |

The first column indicates the amount of ore relative to the total amount of ore before screening. The second column indicates the germanium content. The third column indicates the amount of germanium relative to the total amount of germanium present in the initial sample before screening.

The same amounts, but relative in each case to the sample in question after screening, are indicated in brackets.

The above Table shows that the magnetic separation obtained on the fraction larger than 40 μm is much more effective than that obtained on the fine fraction (0–40 μm). More precisely, in the coarser fraction, the magnetic fraction (concentrate) contains 1319 g/l of germanium and almost 88% of the amount of germanium present in the initial fraction screened at +40 μm.

On the other hand, in the finer particle size fraction, the germanium enrichment is admittedly very significant, but only less than 37% of the germanium present in the initial fraction screened at 0–40 μm is recovered, a very large part of this fraction ending up with the non-magnetic materials.

This last test therefore confirms the value of treating a product which is as granular as possible, so as to avoid the significant losses appearing in the fine particle sizes; it is found in this respect that, even with a fairly coarse product, a good separation between the various phases of the ore is obtained, as already mentioned above.

Depending on the sample of ore tested, it was found that the finer particle size fraction (0–40 μm here) could contain larger or smaller amounts of germanium. In the case of small amounts, this fraction can be sent to the sterile materials. In the case of large amounts, on the other hand, this fraction is advantageously incorporated with the enriched magnetic fraction of the part sorted at 40 micrometers or above.

Of course, the present invention is in no way limited to the embodiment described above; on the contrary, those skilled in the art will know how to apply any variant or modification thereto in accordance with the spirit of the invention.

We claim:

1. A process for increasing the amount of germanium recovered from supergene ore, comprising the steps of:

a) crushing the supergene ore;

b) converting the crushed ore to pulp;

c) subjecting the pulp obtained in step b) to a magnetic separation which separates a magnetic fraction consisting essentially of an iron hydroxide phase containing the germanium from a non-magnetic fraction;

d) retaining the separated magnetic fraction;

e) subjecting the retained magnetic fraction of step d) to a second crushing step and to a second magnetic separation step which separates a second magnetic fraction consisting essentially of the iron hydroxide phase containing the germanium from a second nonmagnetic fraction; and f) retaining the second magnetic fraction for subsequent extraction of the germanium from the second magnetic fraction.

2. The process of claim 1, wherein the supergene ore is crushed to a $diameter_{80}$ of between 50 and 500 micrometers.

3. The process of claim 1, wherein the supergene ore is crushed to a $diameter_{80}$ of about 200 micrometers.

4. The process of claim 1, wherein the magnetic separation is carried out under a magnetic field of between 0.5 and 5 Tesla.

5. The process of claim 1, further comprising the steps of subjecting the nonmagnetic fraction separated in step c) to a second magnetic separation under a higher field than in the first magnetic separation which separates a second magnetic fraction consisting essentially of the iron hydroxide phase containing the germanium from the non-magnetic fraction; and retaining the second magnetic fraction for subsequent extraction of the germanium from the second magnetic fraction.

6. The process of claim 1, wherein the conversion step of step b) is preceded by a screening step to separate smaller particles from larger particles of the crushed ore; and subjecting only the larger particles to the conversion and magnetic separation steps.

7. The process of claim 6, wherein the screening step separates the particles into the smaller and larger particles whose particle sizes are respectively less than and greater than 40 micrometers.

8. The process of claim 1, wherein the ore is crushed by a wet method in a ball mill.

9. The process of claim 8, wherein the ore is crushed with a solids concentration of between 50 and 65%.

10. The process of claim 1, wherein the pulp subjected to the magnetic separation step contains from 50 to 500 grams of ore per liter.

11. The process of claim 1, wherein the pulp subjected to the magnetic separation step contains from 150 to 200 grams of ore per liter.

12. A process for increasing the amounts of germanium and gallium recovered from supergene ore, comprising the steps of:

a) crushing the supergene ore;

b) converting the crushed ore to pulp;

c) subjecting the pulp obtained in step b) to a magnetic separation which separates a magnetic fraction consisting essentially of an iron hydroxide phase containing the germanium and a jarosite phase containing the gallium from a non-magnetic fraction;

d) retaining the separated magnetic fraction;

e) subjecting the retained magnetic fraction of step d) to a second crushing step and to a second magnetic separation step which separates a second magnetic fraction consisting essentially of the iron hydroxide phase containing the germanium and the jarosite phase containing the gallium from a second non-magnetic fraction; and f) retaining the second magnetic fraction for subsequent extraction of the germanium and the gallium from the second magnetic fraction.

13. The process of claim 12, wherein the ore is crushed to a $diameter_{80}$ of between 50 and 500 micrometers.

14. The process of claim 12, wherein the ore is crushed to $diameter_{80}$ of about 200 micrometers.

15. The process of claim 12, wherein the magnetic separation is carried out under a magnetic field of between 0.5 and 5 Tesla.

16. The process of claim 12, further comprising the steps of subjecting the nonmagnetic fraction separated in step c) to a second magnetic separation under a higher field than in the first magnetic separation which separates a second magnetic fraction consisting essentially of the iron hydroxide phase containing the germanium and the jarosite phase containing the gallium from the non-magnetic fraction; and retaining the second magnetic fraction for subsequent extraction of the germanium and the gallium from the second magnetic fraction.

17. The process of claim 12, wherein the conversion step of step b) is preceded by a screening step to separate smaller particles from larger particles of the crushed ore; and subjecting only the larger particles to the conversion and magnetic separation steps.

18. The process of claim 17, wherein the screening step separates the particles into the smaller and larger particles whose particle sizes are respectively less than and greater than 40 micrometers.

19. The process of claim 12, wherein the ore is crushed by a wet method in a ball mill.

20. The process of claim 19, wherein the ore is crushed with a solids concentration of between 50 and 65%.

21. The process of claim 12, wherein the pulp subjected to the magnetic separation step contains from 50 to 500 grams of ore per liter.

22. The process of claim 12, wherein the pulp subjected to the magnetic separation step contains from 150 to 200 grams of ore per liter.

* * * * *